US006090181A

United States Patent [19]

Sakurai et al.

[11] Patent Number: 6,090,181

[45] **Date of Patent: *Jul. 18, 2000**

[54] BLAST FURNACE OPERATING METHOD

[75] Inventors: Syouji Sakurai; Takanari Kawai; Hirotoshi Fujimori; Yoshiyuki Nakajima, all of Tokyo, Japan

[73] Assignee: Kawasaki Steel Corporation, Hyogo-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/669,464

[22] PCT Filed: Nov. 7, 1995

[86] PCT No.: PCT/JP95/02272

§ 371 Date: Jul. 9, 1996

§ 102(e) Date: Jul. 9, 1996

[87] PCT Pub. No.: WO96/15277

PCT Pub. Date: May 23, 1996

[30] Foreign Application Priority Data

Nov. 9, 1994 [JP] Japan ..... 6-275020

[51] Int. Cl.[7] ..... C21B 5/00

[52] U.S. Cl. ..... 75/378; 75/471

[58] Field of Search ..... 75/471, 378

[56] References Cited

U.S. PATENT DOCUMENTS 4,963,186 10/1990 Shimizu et al. ..... 75/378

5,486,216 1/1996 Shigeno et al. ..... 44/591

FOREIGN PATENT DOCUMENTS

| | | | |
|---|---|---|---|
| 50-119701 | 9/1975 | Japan . | |
| 53-63206 | 6/1978 | Japan . | |
| 61-12803 | 1/1986 | Japan . | |
| 62-199706 | 9/1987 | Japan . | |
| 1-65207 | 3/1989 | Japan . | |
| 1-65216 | 3/1989 | Japan . | |
| 6108126 | 4/1994 | Japan | 75/471 |
| 7-228904 | 8/1995 | Japan . | |

*Primary Examiner*—Melvyn Andrews
*Attorney, Agent, or Firm*—Dvorak & Orum

[57] ABSTRACT

A method of operating a blast furnace enables substantial improvement of gas permeability and liquid permeability for stable operation of the blast furnace, involves packing the core section with solid high strength, carbonaceous blocks prior to ignition of the furnace. The carbon blocks resist wearing and high temperature reaction over very long periods of operating time, greatly stabilizing the furnace. Because of the improved stabilization, gas permeability and liquid permeability, a low grade solid reducing agent can be substituted for a quantity of the high quality coke normally used for operating the blast furnace and furthermore enables injection of pulverized coal at a rate of at least 200 Kg/ton-pig.

3 Claims, 4 Drawing Sheets

SOLID LINE: FLUCTUATIONS OF WIND PRESSURE (ΔP/L)

BLOKEN LINE: DROPPING RATE TO TUYERE

| | |
|---|---|
| A | SUITABLE CHARGE |
| B | EXCESSIVE CHARGE |
| C | UNDER CHARGE |

BLAST FURNACE OPERATING METHOD

TECHNICAL FIELD

The present invention relates to a method of operating a blast furnace for producing pig iron, and more particularly to a technology for enabling use of low grade solid reducing agents such as charcoal as well as injection of a large quantity of pulverized coal in a blast furnace by forming a packed bed comprising high strength blocks in the central core of the blast furnace.

BACKGROUND ART

Generally, it is very important to insure gas permeability and liquid permeability in a blast furnace for producing pig iron during its operation into which coke (generic name for iron ore, sintered ore, lime stone, and the like) are loaded therein. When gas permeability in a blast furnace becomes lower, increase of pressure loss or non-uniformed gas flow may occur with defective descent of the burden (frequent occurrence of hanging and slip). which in turn not only makes the operation unstable but also lowers a reaction efficiency in the entire furnace as well as productivity of the blast furnace. Furthermore, when the liquid permeability becomes lower, slag overburden is generated at the tuyere level, which causes not only non-uniformity in gas distribution in the furnace, but also tap hole deviation and a rise in the pressure of in the furnace, thereby causing a non-uniform tap output rate from each tap hole. This phenomenon also causes defective decent of the burden and damages the operational stability of the furnace. In relation to the gas permeability and liquid permeability in a blast furnace, it has been recognized that the operational factors, such as gas permeability and liquid permeability are especially important in the core section. The core section comprises a lower section of the tuyere level and a core coke layer existing under a zone where the ores are softened and melted (Refer to FIG. 1). The function of the core section 7 is to control gas flow distribution in a furnace, and as a result, its construction effects the stability and descent of the burden. When the furnace utilizes pulverized coal injection, the core section 7 serves as a path for unburned materials to pass from the tuyere, up to the softening and melting zone.

In order to provide the proper heat source, reducing capacity, gas distribution (gas permeability), liquid permeability and the dropping of molten metal and slag, a relatively high quality coke for the blast furnace has been used. Apart from the possible problem of future exhaustion of feed stock coal used for producing such high quality blast furnace coke, there is the problem that blast furnace coke typically has a high porosity, or a low compression strength or a low strength after reaction (CSR) nature. Even in a case where the coke for a blast furnace has a relatively higher quality than that of commercial coke, the coke can become powdered due to various types of physical or chemical phenomena generated in the furnace. For this reason, it is difficult to completely stabilize the operations of a blast furnace and to improve the gas and liquid permeability by only using a high quality blast furnace coke.

An attempt in overcoming the problems described above, is found in Japanese Patent Laid-Open Publication No. 63206/1978. The disclosure discusses a method of operating a blast furnace for which coke is used, characterized in that 3 to 25% of the total charged coal materials by weight is replaced with high strength block made of fine carbonaceous materials, and where coke fine materials are mixed with the coke for use in the blast furnace.

With that method however, as the fines and high strength coke was charged into the furnace in place of the ordinary coke, the gas permeability was temporally improved, but the high strength block intruded into some areas other than the core section of the furnace. That condition lowered the furnace reaction efficiency of the entire furnace. Furthermore, the high strength blocks descended to the raceway section in front of the tuyere, which in turn, caused incomplete combustion of the coke, and in addition, oxygen to climb to the upper side of the furnace, which in turn caused the FeO-rich slag to drop to the raceway section, causing that section to become unstable. All of these conditions made it difficult to stabilize operations of the blast furnace.

Another disclosure discussing the technology for preserving the gas permeability and the liquid permeability in stable condition as well as for enhancing furnace operational stability, is found in the "Method for controlling a solid reducing bed in a furnace core during operations of a blast furnace" disclosed in Japanese Patent Laid-Open Publication No. 65207/1989. In this publication, the method disclosed is one to control the gas permeability and liquid permeability through the coke layer, which is continuously updated in association with proceeding of the blast furnace operation, and use of a solid reducing agent. The solid reducing agent is charged into the core section of the ore layer and the solid reducing agent is charged into the core section as a solid reducing agent layer, and simultaneously the core section of the layer is specified as inside of the core section area in the furnace, where the relation as indicated by the expression of $r_t \geqq 0.03\ R_t$ is satisfied, where the solid reducing agent to be charged into the core section, is charged such that the agent charged into the specific areas occupies 0.2% or more by weight of the total weight of the solid reducing agent charged into the entire core section. Herein, the variable $R_t$ indicates a radius of the furnace top section, and the variable $r_t$ indicates a set radius from the furnace core, in the furnace top section.

In that methodology however, high-quality coke with high hot/cold compression strength and adjusted granularity is always charged into and used in a central portion of the furnace, so that although it can be expected that the gas permeability and liquid permeability will be improved to some extent as compared those in the conventional technology, the effect is practically the same as that in a case where only typical blast furnace coke is used, and for this reason substantial improvement of the gas permeability and liquid permeability can not be expected. It is suggested in the publication that silicon carbide bricks or graphite bricks or the like, each with a low reactivity may used in place of high-quality coke. Regardless of what type of bricks are charged into the furnace, it is predicted that the same problems as those relating to the technology disclosed in Japanese Patent Laid-Open Publication No. 63206/1978 may occur, and for this reason, there are still some questions left as to whether the operation can fully be stabilized or not.

On the other hand, injection of pulverized coal into a blast furnace is known to be an effective alternative to the use of a high quality r educing agent, but injection increases the production of fine materials in the gas circulating inside the furnace and unburnt materials deposited in the core section, causing the gas distributing function to become disturbed, which in turn worsens the gas permeability as well as the liquid permeability. Accordingly, with pulverized coal injection, the stable operation is still uncertain, and it is said that the coal injection rate is limited to tip to 200 kg/ton-pig so long as the current type of blast furnace coke is used for commercial operation. For the reasons described above, it is an object of the present invention to substantially improve the gas permeability and liquid permeability inside the core section of the furnace in order to stabilize furnace operation for the injecting of pulverized coal. Furthermore, it is another object to use a large quantity of low grade solid reducing agent instead of the high quality coke.

SUMMARY OF THE INVENTION

The present invention solves the problems described above by providing a method of operating a blast furnace which stabilizes the furnace so that the gas permeability and liquid permeability in the blast furnace can be substantially improved as compared to those provided by the current technology, and secondly to provide a method of operating a blast furnace which uses a low grade solid reducing agent and injection of pulverized coal at a rate of more than 200 kg/ ton-pig so that a rate of use of high quality coke in the blast furnace will substantially be reduced.

With the present invention, various functions of coke in a blast furnace were studied and it was found that as the content of volatile matter in the feed stock coal used for the production of coke was high, the porosity was also high and the reaction area was rather excessive, and because of that, the coal was easily converted to minute particles due to lowering of the strength. For this reason, the present invention is concerned with supplying material with a main ingredient which does affect acquisition of the melted iron component or have a low porosity, but rather is a substance with high specific ratio and high compression strength, and which hardly reacts to any other material in the furnace, in order to realize substantially higher a gas permeability and liquid permeability as compared to those provided by the current technology.

Namely, the present invention involves a method of operating a blast furnace where coke and ores are charged into the furnace top, and where a zone for charging a high strength block is formed in a core section of the blast furnace during operation. In addition to the method described above, the present invention provides a method of operating a blast furnace where the high strength block is either charged from a furnace top of the blast furnace or where a high strength block packed bed area is formed before the blast furnace is ignited. The invention also involves a method of operating a blast furnace characterized in that a high strength block is prevented from being piled up in sections other than the core section and is prevented from being piled up in sections other than the core section based on a result of observation of the high strength block dropping to the tuyere level, as well as on a measurement value of an average pressure loss in the blast furnace. Furthermore, the present invention also provides a method characterized in that a low grade solid reducing agent is used as a substitute for the typical commercial grade coke, and where coal is injected into the furnace from the tuyere; and furthermore a method of operating a blast furnace characterized in that a rate of injecting said pulverized coal is set to 200 Kg/ton-pig or more.

DETAILED DESCRIPTION OF THE PRESENT INVENTION

Figure 1:
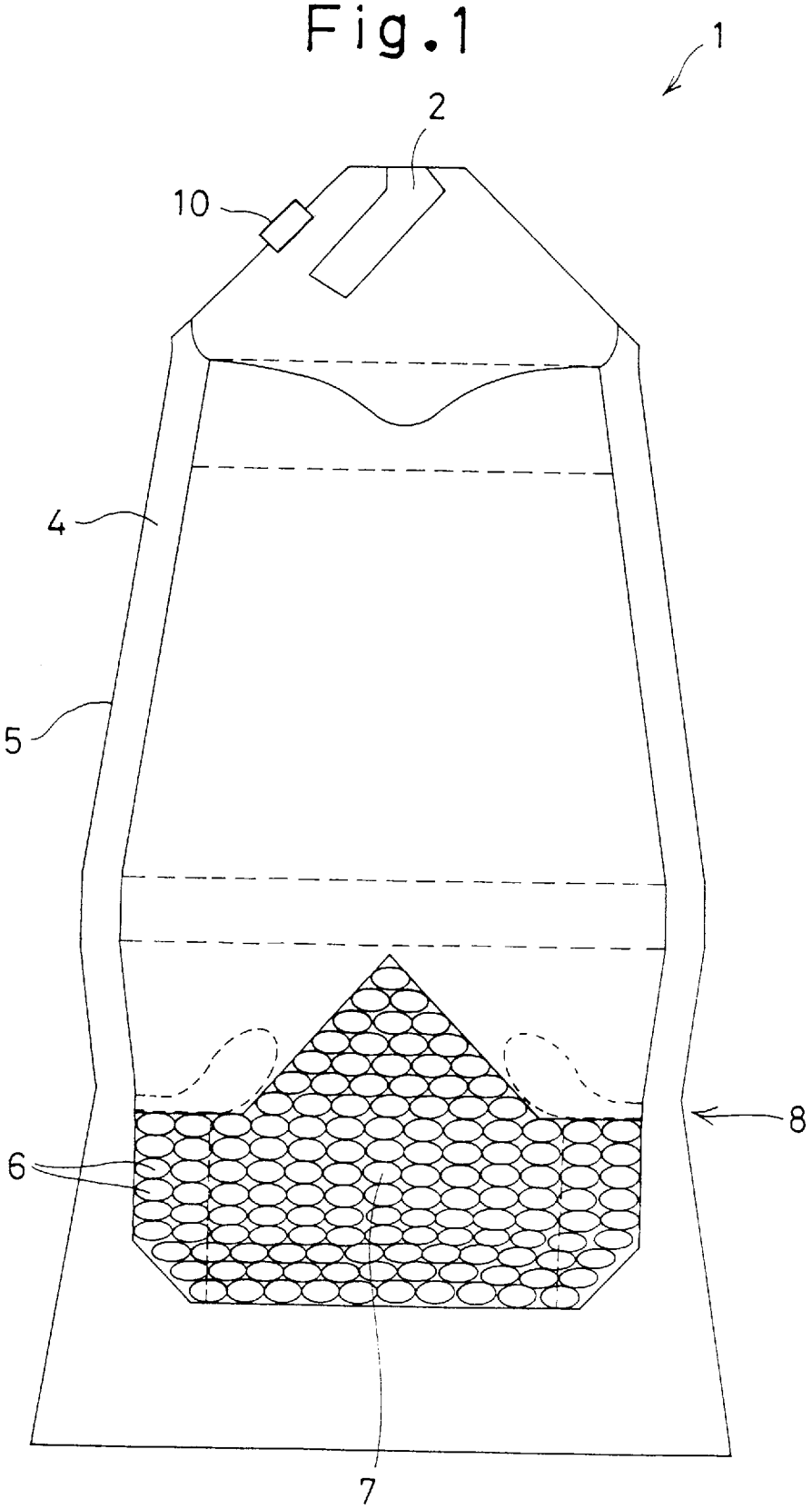
FIG. 1 is a diagrammatic view showing a high strength block packed area in the core section of a blast furnace according to the present invention.

In the present invention, "a core section of a furnace" indicates, as described above, a portion comprising a lower section of the tuyere level in the blast furnace and a core coke layer existing under a zone where the iron ores are softened and melted (Refer to FIG. 1), and "additional charge" indicates a case where the high strength block is not charged into the furnace each time when coke and ores are charged thereinto, but the block is charged thereinto only when the block does not form a packed area therewith in the core section of the furnace; namely it means an operation of intermittently charging the high strength block. Also the "high strength block" is defined as a material which is much stronger against powdering due to a reaction under a high temperature, wearing, and compression than that of commercial blast furnace coke, and also which hardly reacts with pig iron and slag, and which has values for the physical properties as shown in Table 1 below. Furthermore, the "low grade solid reducing agent" indicates charcoal or the like, and values for those physical properties are as shown in Table 2 below.

In the present invention, the operation for producing pig iron by charging coke and ores from the furnace top is executed in the state where a high strength block packed area has been formed in the core section of the blast furnace, so that it is possible to prevent the core section of the blast furnace from being clogged with combustion ash, unburned materials, or dust or the like, and which makes it possible to remarkably improve the gas permeability and liquid permeability in the blast furnace.

When ordinary blast furnace coke is used for operation of a blast furnace, coke in the furnace core section is updated once for every week or every two weeks of operation, but to achieve the object of the present invention, it is required that the blast furnace coke reside for a longer period of time in the furnace as well as that the coke does not become pulverized. In the present invention, a high strength block having a strength after a reaction under a high temperature (CSR) of 70% or more, preferably 90% or more, and most preferably 95% or more, and a tumbler index, which is a reference for prevention of wearing due to contact between solids, of 88% or more, preferably 95% or more, and a compression strength two or more times higher than that of the blast furnace coke is used. A high strength block as such can reside in the furnace core for at least a minimum of 10 weeks and for a maximum of up to 20 weeks. Herein the strength after a reaction under a high temperature (CSR) is defined as a value provided by the hot static reaction and cold rotation testing method for a large size blast furnace, as described in Steel Handbook II Iron Manufacture, Steel Manufacture (Edited by Japan Iron Manufacture Association), 3rd edition, page 202, Table 4.23, wherein the value is obtained by reacting the coke for 120 minutes in a $CO_2$ gas atmosphere under a temperature, in the range of 1000±10° C. at a flow rate of 125 litters/min, and then charging the coke according to the JIS drum testing method into a drum, rotating and pulverizing the coke in the drum, and measuring a content of $D_{15}^{150}$.

Also in the present invention, the high strength block can be charged from a furnace top into the blast furnace, or the high strength block is a packed area formed before the blast furnace is ignited, so that the desired high strength block packed area can easily be formed at a core section of the blast furnace.

Figure 2:
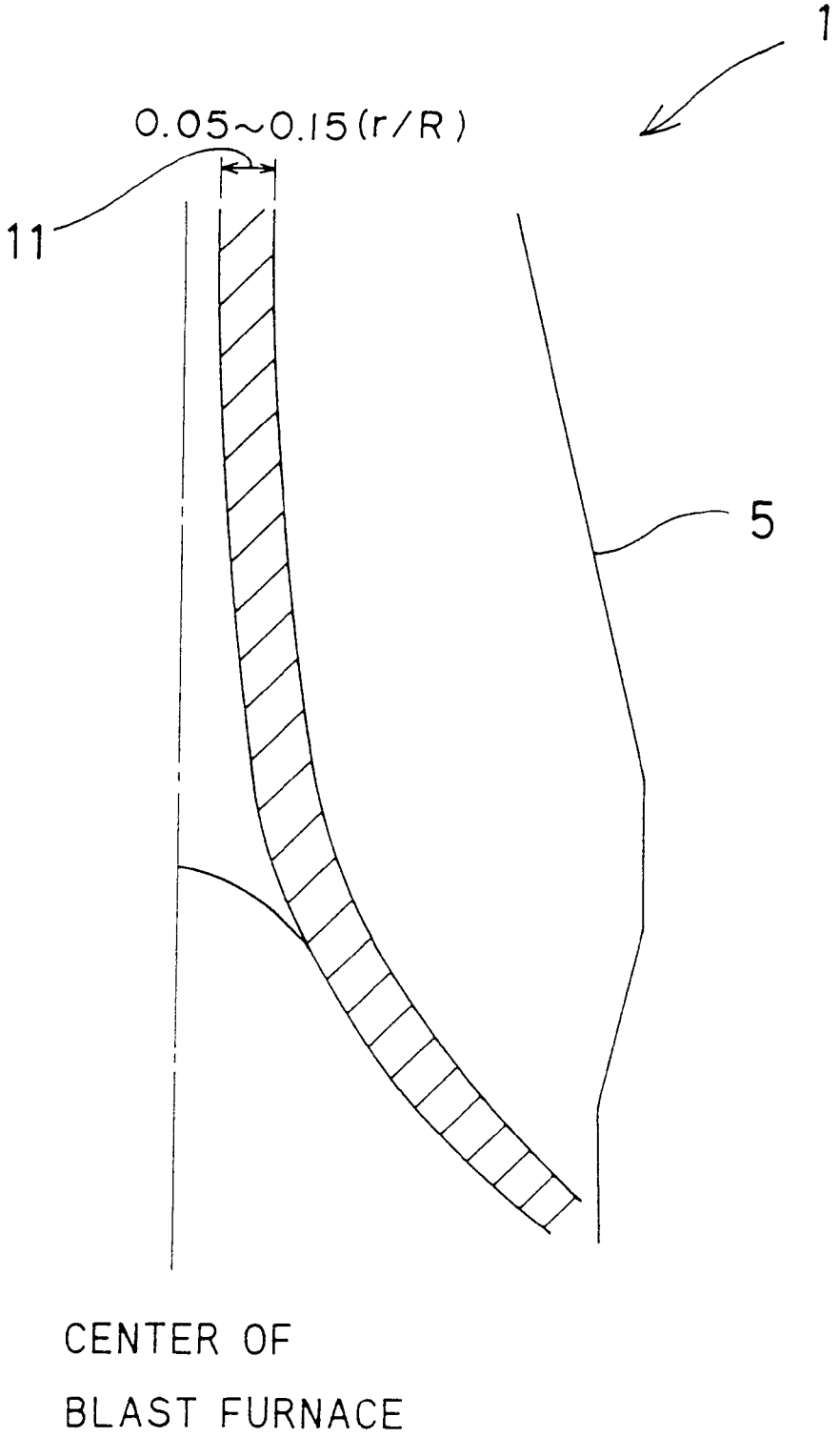
FIG. 2 is a diagrammatic view showing an example in which a position for charging the high strength block into the furnace is fixed when the method for operating a blast furnace according to the present invention is carried out.

Any available method may be used as a method for charging the high strength block into a blast furnace, and core coke is added charged, as when ores or coke is intermittently charged into the furnace, into a core section of the blast furnace in addition to the respective charging rate, or when coke is charged into a blast furnace, core coke is mixed in the coke, and the mixture is continuously or intermittently charged into a doughnut section 11 adjacent to a ridge of the core section as shown in FIG. 2. These methods may be employed because, as a result of a cold model experiment simulating a solid flow in a blast furnace, it has been found that the coke charged into the doughnut section 11 flows along a ridge of the conical section of the furnace core and updates the furnace core coke. It should be noted that a rate of charging high strength block/coke for one cycle of operation of a blast furnace with the internal capacity of 2500 $m^3$ should be 0.2 weight % or less, and preferably 0.06% or less.

Also in the present invention, the high strength block is prevented from being piled up in any section other than the furnace core section by monitoring the high strength block dropping to the tuyere level and by measuring the average pressure loss in the blast furnace, so that unnecessary high strength blocks are never piled up in any section other than the furnace core.

Figure 3:
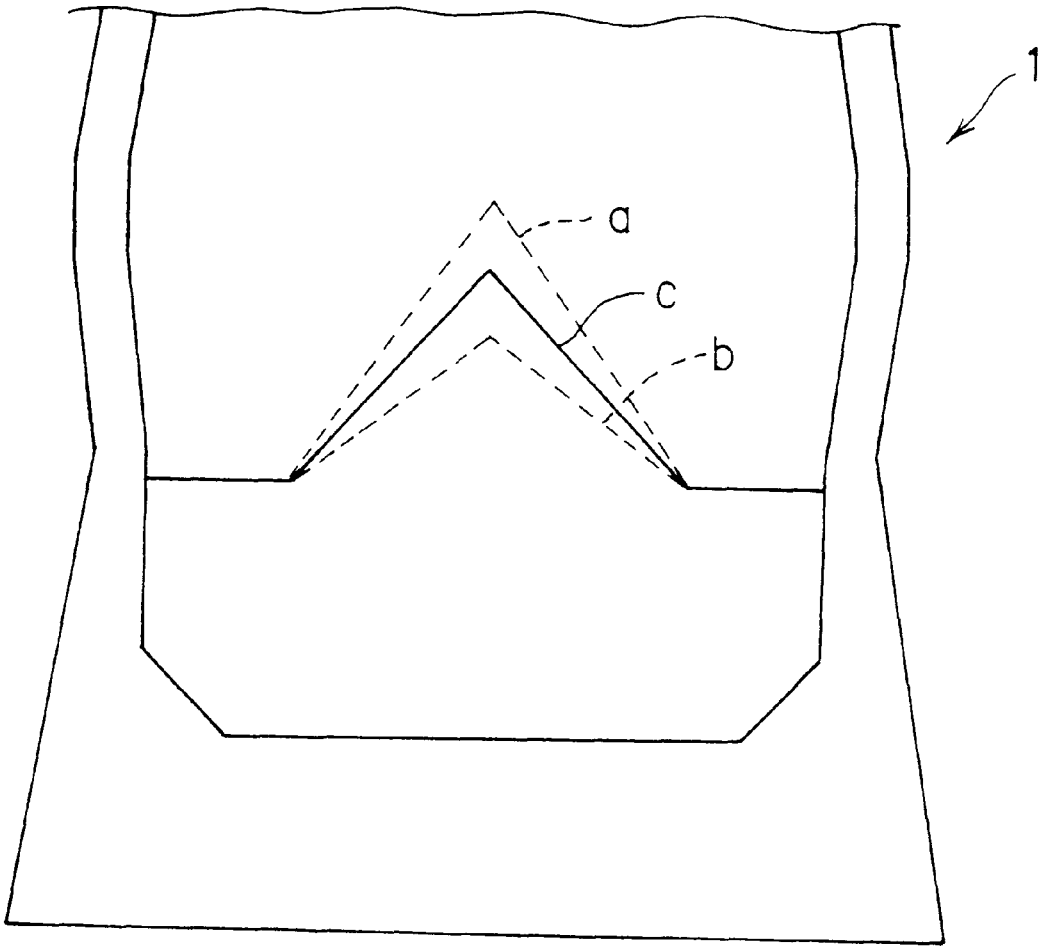
FIG. 3 is a diagrammatic view schematically showing a position where the high strength block according to the present invention is present in the core section of the blast furnace, wherein "a" indicates an excess of the high strength block therein, while "b" indicates a shortage of the high strength block therein.
Figure 4:
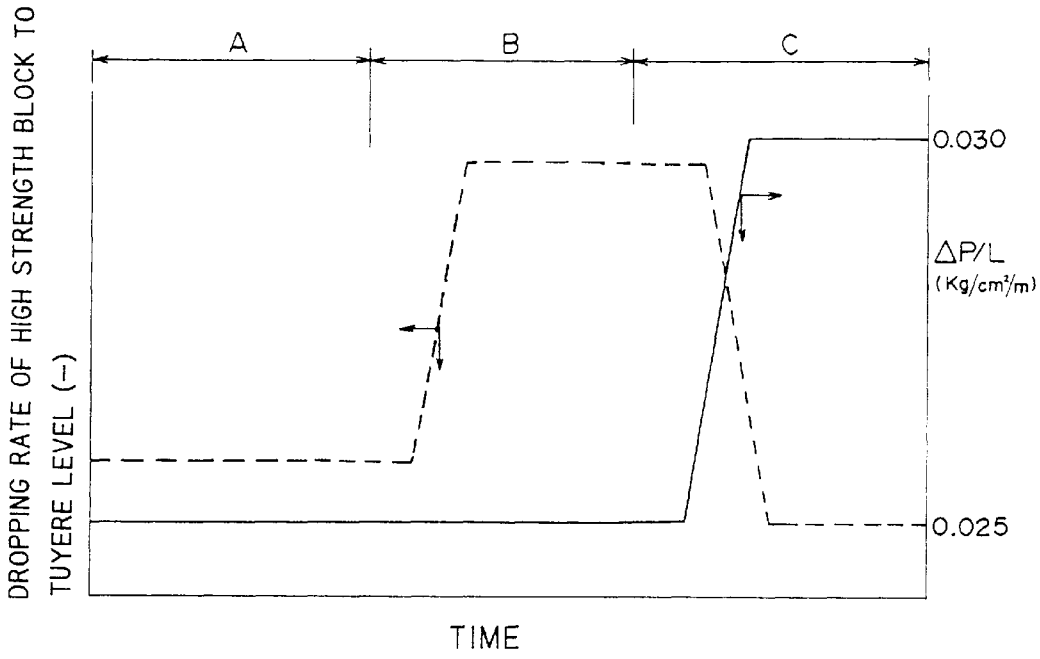
FIG. 4 is a graph showing a dropping rate of the high strength block according to the present invention to the tuyere level and fluctuations of wind pressure in the blast furnace.

Control over residing of the high strength block in the furnace core can easily be provided by visually monitoring the situation in the blast furnace from the tuyere as schematically shown in FIG. 3. An alternative method of monitoring the internal situation inside the blast furnace is to monitor the shape of the furnace core, making use of various types of sonde measurements (such as from a tuyere level, a furnace top location, and an inclined location). In this step, if the furnace core section has expanded (as shown in FIG. 3*a*) beyond the reference position for the core section (shown in FIG. 3*c*), an action is executed to reduce the charging rate or a frequency of the charging operations, and if the furnace core section has shrank from the reference position (as shown in FIG. 3*b*), an action is performed to increase the charging rate or the frequency of charging. A wind pressure in the blast furnace is also measured, as shown in FIG. 4, by checking fluctuations of the wind pressure according to a size of the furnace core section. It should be noted that, as clearly shown in FIG. 4, a time delay is generated while the high strength block is charged or is dropping to the tuyere, or while the wind pressure is fluctuating. Also in the present invention, a low grade solid reducing agent is used as a substitute for coke, so that a quantity of relatively high quality coke which is normally used for operating the blast furnace, can be reduced, or the blast furnace can be operated even if the high quality coke is not available. The reason being when high strength block is charged and a furnace core section is formed, the gas distribution function is stabilized and the coke is then functioning only as a heat source with a reducing capability.

Furthermore in the present invention, coke and ores are first mixed with each other and the mixture is charged from a furnace top of a blast furnace, and the pressure loss in the blast furnace can be reduced by around 100% as compared to a case where coke and ores are charged independently into a layered form. In the conventional type of blast furnace operation in which coke and ores are mixed and charged into a blast furnace, a substantially large work load is required for operations to form a softening and melting zone which exhibits stable conditions. A large work load is also required to stabilize the gas distribution in the radial direction in the blast furnace, and to provide control over the distribution of burden materials from the furnace top, the granularity of coke and ores, and the blending of ores; the large work load also makes it difficult to stabilize operations of the blast furnace for a long, period of time. However, in a case where a furnace core section according to the present invention is formed, the gas permeability and liquid permeability are improved and the gas distributing function as well as the central flow can be insured, which enables stable operations of the blast furnace. In a preferred embodiment for carrying out the present invention, pulverized coal is blown into a blast furnace from the tuyere and a rate of blowing the pulverized coal is set to 200 Kg/ton-pig or more, so that a required quantity of high quality coke can substantially be reduced. When the conventionally loaded blast furnace coke is used, if the blowing rate is set to 200 Kg/ton-pig, the wind pressure will sharply increase, but this phenomenon never occurs in the present invention.

Supplemental description for the high strength block according to the present invention is provided below.

It is required that the high strength block have a high hot strength with little compression and wearing and a low reactivity with melted iron or slag, and especially that the reactivity with the FeO-rich dropping zone slag or the hearth basin slag be low. For this reason, the high strength block is generally a carbonaceous material such as heat-resistant anthracite or graphite, and it is preferable to manufacture and use particles thereof having a given porosity, specific gravity, and compression strength with a uniform size by using a heat-resistant binder. However, the high strength block is not limited to those described above, and carbon bricks or electrodes having a required quality and granularity or silicon carbide may be used.

Table 1 shows an example of physical property values and analysis values of the high strength block according to the present invention as compared to the values of blast furnace coke usually used for operation of a blase furnace. This table shows that the porosity is lower and both the specific gravity and compression strength are very high as compared to the values of blast furnace coke in all cases. The No. 1 and No. 2 in Table 1 shows examples of carbon bricks, while the No. 3 and No. 4 in the table show examples in which a binder is added to carbonaceous powder and the mixture is newly sintered. The No. 3 shows a case where a carbon content is lower as compared to those in other types of high strength block so that SiC is added to generate the residing capability and where the mixture is then sintered. The No. 4 shows a case where the compression strength is slightly lowered. As shown in this table, all types of carbon block can be used if they have a high strength, and change only a little while the blocks descend from a furnace top to the tuyere level, so that the blocks substantially maintain their original form.

It should be noted that the high strength block has preferably a spherical form, however a cylindrical form as close as possible to a spherical form can be used, as can a cubic form, or a rectangular parallelepiped form as close as possible to a cubic form, and also it is preferred that the size be in a range from 30 to around 150 mm. As a result, it has become possible that a large quantity of fuel (heavy oil, gas, or pulverized coal) or flux powder or the like can be blown into a blast furnace because the high strength block resides in the blast furnace for a long period of time.

The following description describes implementation of the present invention using a test blast furnace having a tapping capacity of 10 tons/day.

Embodiments

The test blast furnace 1 had the specification as shown in Table 3, and parameter values for the burden materials and winding conditions were also as shown in the table, and the parameter values are common to all embodiments and controls. In this experiment, a packed area was formed with the high strength block 6 shown in Table 1 at a core section of the blast furnace 1. stably running under the operation conditions as shown in Table 3. and then comparing the operational results. During each operation, existence of a packed area in the furnace core section 7 and its normality were determined by monitoring the high strength block 6 descending to the tuyere level 8 and by checking fluctuations of wind pressure in the blast furnace. In each embodiment, a period of operation was 14 days, and in each case the high strength block 6 was discharged after the 14 days and all of the residual materials in the furnace was first removed and the furnace cooled down.

Table 4 and Table 5 show contents of the embodiments mentioned above and the results of operation in each embodiment. In these tables, operational stability of the blast furnace is assessed in three categories; slip frequency, gas permeability, and liquid permeability. Also in Table 4 and Table 5, the signs such as No. 1 in the "high strength block" indicate types of high strength block shown in Table 1, and "None" in the column of control indicates that no control is used. Furthermore the phrase of "before ignition" indicates that the furnace core section was formed with the high strength blocks before the furnace was ignited, and it is to be understood that the present invention can fully be carried out by additionally charging the coke three times for 14 days, at a rate of 20 Kg/charge after the blast furnace is ignited. On the other hand, the phrase of "after ignition" indicates that the high strength block is charge 20 times in the relatively earlier stage after start of the blast furnace operation at a rate of 20 Kg/charge to form a core section, and then the high strength block is additionally charged three times.

It is clearly understood from Table 4 and Table 5 that the gas permeability and liquid permeability in controls, in which a furnace core section was formed with commercial coke like in the conventional technology, are lower than those values in the case where the present invention was applied. It is clear that the gas and liquid permeability factors can be improved by applying the blast furnace operation method according to the present invention. Herein the gas permeability is obtained by calculating ΔP (pressure loss)/L (Effective height) in the entire blast furnace, while the liquid permeability indicates a deviation in a tapping rate in each operational cycle when tapping is executed 6 times a day; when this value is large, it indicates that the liquid permeability in the hearth is low. It is clear that the stability of blast furnace operation will not be sacrificed even if charcoal is used as a low grade solid reducing agent in place of the coke generally used in a blast furnace or if pulverized coal is blown into the blast furnace at a rate of 200 Kg/t-pig or more. Furthermore, it is clear that these same effects can be obtained by also charging a mixture of coke and ores.

TABLE 1

| | Commercial | High strength block | | | |
|---|---|---|---|---|---|
| | coke | No.1 | No.2 | No.3 | No.4 |
| Total porosity (%) | 40~50 | 18 | 21.2 | 19 | 20 |
| Compression strength ($Kg/cm^2$) | 100 | 480 | 423 | 380 | 230 |
| Fixed carbon (%) | 94~85.5 | 96.5 | 93.9 | 78.0 | 90.0 |
| Apparent specific gravity ($t/m^3$) | 0.6 | 1.6 | 1.6 | 1.84 | 1.6 |
| Emulsive component | 0.4~0.7 | 0.7 | 0.5 | 1.0 | 0.8 |
| Ash (%) | 5.6~13.8 | 2.7 | 5.6 | 21.0 | 9.2 |
| Post-reaction strength index (CSR) | 50~65 | >95 | >94 | >70 | >90 |
| Tumbler index | 85~87 | >95 | >92 | >90 | >88 |

TABLE 2

| | Post-reaction strength index(CSR) | Tumbler index | Compression strength ($Kg/cm^2$) |
|---|---|---|---|
| Commercial blast furnace coke | 50~65 | 85~87 | 100 |
| Low grade solid reducing agent (such as charcoal) | <50 | <80 | <100 |

TABLE 3

| | |
|---|---|
| Unobstructed capacity | 4 $m^3$ |
| Number of tuyeres | 3 |
| Number of tap holes | 1 |
| Furnace top charging device | Bell-less system |
| Tapping rate | 10 t/d |
| Air blowing rate | 600 N $m^3$ /hr |
| Air blowing temperature | 850° C. |
| Ore ratio | 1600 Kg/t |
| Sinter ratio | 80% |

TABLE 4

| High strength block | Timing for forming a core section with high strength block | Additional charge of high strength block: Method | Additional charge of high strength block: Frequency (during operation for 14 days) | Type of coke | Quantity of coke (kg) | Layered/mixed | PCI rate (kg/t) | Times of slipping | Gas permeability ΔP/L (kg/cm²/m) | Liquid permeability |
|---|---|---|---|---|---|---|---|---|---|---|
| Cases where the present invention was applied | | | | | | | | | | |
| No. 1 | Before ignition | Charged from a furnace top to the zone shown in FIG. 2 | Charged by 20 Kg 3 times | Normal | 650 | Charged in a layered state | 0 | 0 | 0.025 | 1.67 ± 0.07 |
| No. 1 | After ignition | Charged from the furnace top to zone shown in FIG. 2 | Charged by 20 Kg 20 times and then additionally charged by 20 Kg | Normal | 650 | Charged in a layered state | 0 | 1 | 0.030 | 1.67 ± 0.10 |
| No. 2 | Before ignition | Charged from furnace top to zone shown in FIG. 2 | Additionally charged by 20 Kg 3 times | Normal | 650 | Charged in a layered state | 0 | 0 | 0.030 | 1.67 ± 0.10 |
| No. 3 | Before ignition | Charged from furnace top to zone shown in FIG. 2 | Additionally charged by 20 Kg 3 times | Normal | 650 | Charged in a layered state | 0 | 0 | 0.035 | 1.67 ± 0.13 |
| No.4 | Before ignition | Charged from furnace top to zone shown in FIG. 2 | Additionally charged by 20 Kg 3 times | Normal | 650 | Charged in a layered state | 0 | 0 | 0.035 | 1.67 ± 0.13 |
| No. 1 | Before ignition | Charged from furnace top to zone shown in FIG. 2 | Additionally charged by 20 Kg 3 times | Charcoal | 650 | Charged in a layered state | 0 | 0 | 0.050 | 1.67 ± 0.23 |
| No. 1 | Before ignition | Charged from furnace top to zone shown in FIG. 2 | Additionally charged by 20 Kg 3 times | Formed coke | 650 | Charged in a layered state | 0 | 0 | 0.045 | 1.67 ± 0.23 |
| Control | | | | | | | | | | |
| None | None | None | None | Commercial coke | 650 | Charged in a layered state | 0 | 3 | 0.040 | 1.67 ± 0.33 |
| None | None | None | None | Charcoal | 650 | Charged in a layered state | 0 | 3 | 0.060 | 1.67 ± 0.40 |
| None | None | None | None | Formed coke | 650 | Charged in a layered state | 0 | 3 | 0.050 | 1.67 ± 0.40 |

TABLE 5

| High strength block | Timing for forming a core section with high strength block | Additional charge of high strength block: Method | Additional charge of high strength block: Frequency (during operation for 14 days) | Type of coke | Quantity of coke (kg) | Layered/mixed | PCI rate (kg/t) | Gas permeability: Times of slipping | Gas permeability: ΔP/L (kg/cm²/m) | Liquid permeability |
|---|---|---|---|---|---|---|---|---|---|---|
| Cases where the present invention was applied | | | | | | | | | | |
| No. 1 | Before ignition | Charged from a furnace top to the zone shown in FIG. 2 | Charged by 20 Kg 3 times | Normal | 650 | Charged in a mixed state | 0 | 0 | 0.030 | 1.67 ± 0.17 |
| No. 1 | Before ignition | Charged from a furnace top to zone shown in FIG. 2 | Charged by 20 Kg 3 times | Normal | 500 | Charged in a layered state | 150 | 0 | 0.050 | 1.67 ± 0.17 |
| No. 1 | Before ignition | Charged from a furnace top to zone shown in FIG. 2 | Charged by 20 Kg 3 times | Normal | 450 | Charged in a layered state | 200 | 1 | 0.055 | 1.67 ± 0.20 |
| No. 1 | Before ignition | Charged from a furnace top to zone shown in FIG. 2 | charged by 20 Kg 3 times | Normal | 400 | Charged in a layered state | 250 | 2 | 0.060 | 1.67 ± 0.27 |
| Control | | | | | | | | | | |
| None | None | None | None | Commercial coke | 650 | Charged in a mixed state | 0 | 2 | 0.035 | 1.67 ± 0.27 |
| None | None | None | None | Commercial coke | 650 | Charged in a layered state | 150 | 5 | 0.060 | 1.67 ± |
| None | None | None | None | Commercial coke | 450 | Charged in a layered state | 200 | 10 | 0.070 | 1.67 ± 0.40 |
| None | None | None | None | Commercial coke | 400 | Charged in a layered state | 250 | operation impossible | operation impossible | operation impossible |

What is claimed is:

1. A method of operating a blast furnace for manufacturing pig iron in which a carbon reducing agent and ores are charged therein from a furnace top, said furnace including a plurality of tuyeres disposed vertically below said top, thereby defining a tuyere level, comprising the steps of:

selectively pre-packing a core section of the furnace with a plurality of solid high density carbonaceous blocks to form a conically-shaped dead man zone prior to an ignition of said furnace, said ignition representing a start of an operating condition of said furnace;

mixing said ore and carbon reducing agent and then charging said mixture into said furnace on a periodic basis during operation;

starting operation of said furnace by igniting said carbon reducing agent with a continuous blast of hot air;

continuously injecting pulverized coal into said furnace through at least one of said tuyeres during operation of said furnace;

continuously monitoring a pressure within the furnace between said furnace core and said furnace top in order to formulate a base furnace differential pressure;

monitoring a shape of said dead man zone during operation;

periodically replenishing said dead man zone by charging additional high density blocks into said furnace through said furnace top when said pre-packed blocks of said dead man zone reach said tuyere level;

monitoring a position of said replenished blocks immediately after they are charged;

evaluating said pressure measurements and said position of said replenished blocks in order to one of, add additional blocks when said differential pressure is low relative to a base differential pressure, and delay charging additional blocks if said pressure is high relative to said base differential pressure.

2. The method of operating a blast furnace according to claim 1, wherein said high density carbonaceous blocks comprise a material having a CSR index of at least 80, a compression strength of at least 380 kg/m$^2$, a specific gravity of at least 1.6 t/m$^3$, and a total porosity between 18–22%.

3. The method of operating a blast furnace according to claim 2, wherein said carbon reducing agent comprises a material having a CSR index of 50 and below, and a tumbler index of less than 80.

* * * * *

UNITED STATES PATENT AND TRADEMARK OFFICE

CERTIFICATE OF CORRECTION

PATENT NO. : 6,090,181
DATED : July 18, 2000
INVENTOR(S) : Syouji Sakurai, et al.

It is certified that error appears in the above-identified patent and that said Letters Patent is hereby corrected as shown below:

After "KAWASAKI STEEL CORPORATION AND ADDRESS"

insert: -- Syouji SAKURAI, Tokyo, Japan--

Signed and Sealed this

Twelfth Day of June, 2001

Nicholas P. Godici

*Attest:*

*Attesting Officer*

NICHOLAS P. GODICI
*Acting Director of the United States Patent and Trademark Office*